US009890973B2

(12) United States Patent
Sakai et al.

(10) Patent No.: US 9,890,973 B2
(45) Date of Patent: Feb. 13, 2018

(54) TURBO REFRIGERATOR

(75) Inventors: Naoto Sakai, Osaka (JP); Hayato Sakamoto, Kobe (JP); Masafumi Yamauchi, Nishinomiya (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 803 days.

(21) Appl. No.: 14/008,524

(22) PCT Filed: Mar. 30, 2011

(86) PCT No.: PCT/JP2011/001906
§ 371 (c)(1),
(2), (4) Date: Nov. 7, 2013

(87) PCT Pub. No.: WO2012/131770
PCT Pub. Date: Oct. 4, 2012

(65) Prior Publication Data

US 2014/0047861 A1 Feb. 20, 2014

(51) Int. Cl.
*F25B 1/10* (2006.01)
*F25B 1/00* (2006.01)
*F25B 1/053* (2006.01)

(52) U.S. Cl.
CPC ..... *F25B 1/00* (2013.01); *F25B 1/053* (2013.01); *F25B 1/10* (2013.01); *F25B 2400/071* (2013.01)

(58) Field of Classification Search
CPC .... F25B 1/053; F25B 1/00; F25B 1/10; F25B 11/04; F25B 2400/071; F25B 2400/07; F25B 2500/01; F25B 2500/17
(Continued)

(56) References Cited

U.S. PATENT DOCUMENTS 1,797,287 A * 3/1931 Kucher ..... F25B 1/04 417/410.1
2,042,812 A 6/1936 Tull et al.
(Continued)

FOREIGN PATENT DOCUMENTS

DE 7120748 U 9/1971
DE 102008016627 A1 10/2009
(Continued)

OTHER PUBLICATIONS

ISA European Patent Office, Extended European Search Report in EP11862657, dated Aug. 11, 2014, Germany, 5 pages.
(Continued)

*Primary Examiner* — Joseph Trpisovsky
(74) *Attorney, Agent, or Firm* — Alleman Hall Creasman & Tuttle LLP

(57) ABSTRACT

In a turbo refrigerator in which: a gas-phase refrigerant from an evaporator is compressed by a turbo compressor and then condensed by a condenser; the obtained liquid-phase refrigerant is evaporated by the evaporator; and a cooling target is cooled down by evaporation heat of the liquid-phase refrigerant, the compressor is a back-to-back two-stage centrifugal type, and the condenser is provided at a position outside a compressor rear stage so as to overlap the compressor rear stage when viewed from each of an axial direction and a radial direction. With this, the pressure loss of a vapor refrigerant is eliminated, and the deterioration in efficiency can be suppressed. In addition, size reduction can be realized by space saving. Further, an evaporated refrigerant can be smoothly introduced to the condenser with a simple configuration.

10 Claims, 5 Drawing Sheets

(58) Field of Classification Search
USPC ..... 62/510, 498, 115
See application file for complete search history.

(56) References Cited

U.S. PATENT DOCUMENTS

| | | | | | |
|---|---|---|---|---|---|
| 2,151,564 | A | | 3/1939 | Robinson | |
| 2,151,565 | A | | 3/1939 | Robinson | |
| 2,361,854 | A | * | 10/1944 | McCormack | F25B 39/04 165/907 |

FOREIGN PATENT DOCUMENTS

| | | | | | |
|---|---|---|---|---|---|
| FR | 1285112 | A | | 2/1962 | |
| GB | 413062 | A | | 7/1934 | |
| JP | S521554 | A | | 1/1977 | |
| JP | S5279352 | A | | 7/1977 | |
| JP | S61268967 | A | | 11/1986 | |
| JP | S6467564 | A | | 3/1989 | |
| JP | 2001165514 | A | | 6/2001 | |
| JP | 4191477 | B2 | | 9/2008 | |
| WO | 0198665 | A1 | | 12/2001 | |
| WO | WO 2009121547 | A2 | * | 10/2009 | F25B 30/02 |

OTHER PUBLICATIONS

State Intellectual Property Office of the People's Republic of China, Office Action and Search Report Issued in Application No. 201180069212X, dated Nov. 2, 2014, 9 pages. (Translation of Search Report Portion Provided).
Japanese Patent Office, International Search Report of PCT/JP2011/001906, WIPO, dated May 24, 2011, 2 pages.

* cited by examiner

TURBO REFRIGERATOR

TECHNICAL FIELD

The present invention relates to a turbo refrigerator configured to compress a gas-phase refrigerant by a turbo compressor, condenses the refrigerant by a condenser, evaporates the obtained liquid-phase refrigerant by an evaporator, and cools a cooling target by evaporation heat of the liquid-phase refrigerant.

BACKGROUND ART

In recent years, one type of such a turbo refrigerator has been proposed that is configured to use water as a refrigerant instead of a greenhouse effect gas, such as chlorofluorocarbon, as an environmental measure. In such a turbo refrigerator, the water having a higher boiling point than the chlorofluorocarbon is evaporated under low pressure, so that the refrigerant decreases in density and increases in volume flow rate. Therefore, the turbo compressor tends to increase in size. In contrast, heat exchangers, such as a condenser and an evaporator, do not increase in size as much as the turbo compressor does since the water has better thermal conductivity than the chlorofluorocarbon.

To be specific, although the devices increase in size, the turbo compressor, the condenser, and the evaporator do not increase in size at an equal rate, but only the turbo compressor increases in size as compared to the other components. Therefore, in a case where a typical structure of a chlorofluorocarbon turbo refrigerator in which a turbo compressor and a heat exchanger are formed as separate components and are connected to each other via a pipe is applied to a water refrigerant turbo refrigerator, only the turbo compressor increases in size, and a large dead space remains around a centrifugal impeller.

In a case where the pipe and the like are reduced in size as much as possible in order to suppress increases in sizes of the devices as much as possible, the flow velocity of the refrigerant tends to increase, and this increases the pressure loss. Thus, the performance of the turbo refrigerator deteriorates.

To solve these problems, proposed is a turbo refrigerator in which impellers of a two-stage centrifugal turbo compressor are arranged back-to-back (Japanese Patent No. 4191477). Instead of collecting by a scroll a refrigerant radially flowing out and then introducing the refrigerant to a pipe extending to a condenser, in the turbo refrigerator, a plurality of diffuser ducts are provided for each of the first-stage and second-stage impellers, and the first-stage diffuser ducts and the second-stage diffuser ducts are arranged alternately in a circumferential direction.

SUMMARY OF INVENTION

Technical Problem

However, the turbo compressor of the above conventional example is extremely complex in structure. In addition, a large dead space remains around the centrifugal impeller after all.

Here, an object of the present invention is to provide a turbo refrigerator including a centrifugal turbo compressor capable of: suppressing a decrease in efficiency by reducing the pressure loss of a vapor refrigerant due to a connecting pipe; being reduced in size by space saving; and smoothly introducing an evaporated refrigerant to a condenser with a simple configuration.

Solution to Problem

To achieve the above object, a turbo refrigerator according to one aspect of the present invention includes: a turbo compressor configured to compress a gas-phase refrigerant; a condenser configured to condense the gas-phase refrigerant compressed by the turbo compressor; and an evaporator configured to evaporate a liquid-phase refrigerant obtained by the condenser to cool down a cooling target by evaporation heat of the liquid-phase refrigerant. Then, the turbo compressor is a centrifugal type configured to cause the gas-phase refrigerant to flow in a radially outward direction, and the condenser is provided outside the turbo compressor so as to overlap the turbo compressor when viewed from each of an axial direction and radial direction of the turbo compressor. Here, "overlap" denotes a case where at least a part of the condenser overlaps the turbo compressor.

According to the turbo refrigerator, the condenser is provided outside the turbo compressor and at a position around and in the vicinity of the turbo compressor so as to overlap the turbo compressor when viewed from each of the axial direction and radial direction of the turbo compressor. Therefore, the vapor refrigerant radially flowing out from a centrifugal impeller of the turbo compressor can be directly, smoothly supplied to the condenser without flowing through a scroll and a long connecting pipe.

Therefore, the scroll for collecting the evaporated refrigerant and the connecting pipe for introducing the collected vapor refrigerant to the condenser become unnecessary, the scroll and the connecting pipe being provided in the existing turbo compressor. Therefore, there is no pressure loss generated by the scroll and the connecting pipe, so that the deterioration in efficiency of the turbo refrigerator can be suppressed. The condenser is provided by utilizing a space around the turbo compressor, the space being conventionally a large dead space. Therefore, the entire refrigerator can be reduced in size by space saving.

In the present invention, the turbo compressor may be a two-stage centrifugal type in which a compressor front stage and a compressor rear stage are arranged back-to-back so as to be lined up in the axial direction of the turbo compressor, and the condenser may be provided so as to overlap the compressor rear stage when viewed from each of the axial direction and radial direction of the turbo compressor. According to this configuration, the vapor refrigerant radially flowing out from the centrifugal impeller of the compressor rear stage of the two-stage centrifugal turbo compressor can be supplied to the condenser without flowing through the scroll and the long connecting pipe.

In the present invention, in a case where the compressor front stage and the compressor rear stage are lined up from one side in the axial direction toward the other side in the axial direction, and the turbo refrigerator further includes an intermediate passage through which the refrigerant discharged from a radially outer side of the compressor front stage is introduced to a suction port of the compressor rear stage, the suction portion being located at the other side in the axial direction, the condenser may be provided at a space between the intermediate passage and the compressor rear stage. According to this configuration, the vapor refrigerant flowing out from the compressor rear stage can be supplied to the condenser without flowing across the intermediate passage.

In the present invention, an intermediate cooler configured to cool down the refrigerant introduced from the compressor front stage to the compressor rear stage may be provided at the other side of the condenser in the axial direction of the turbo compressor. According to this configuration, the vapor refrigerant compressed by the compressor front stage and increased in temperature is cooled down by the intermediate cooler to be supplied to the compressor rear stage. With this, the compression efficiency of the compressor improves. In addition, the intermediate cooler can be compactly disposed concentrically with the turbo compressor.

Moreover, in the present invention, the turbo compressor may be a multiple-stage centrifugal type including two or more compressor stages lined up in the axial direction, and the condenser may be provided so as to overlap a rearmost one of the compressor stages when viewed from each of the axial direction and radial direction of the turbo compressor. According to this configuration, the vapor refrigerant radially flowing out from the centrifugal impeller of the compressor rearmost stage of the multiple-stage centrifugal turbo compressor can be supplied to the condenser without flowing through the scroll and the long connecting pipe.

Further, in the present invention, even in a case where the turbo compressor is a single-stage centrifugal type, the scroll for collecting the evaporated refrigerant and the connecting pipe for introducing the collected vapor refrigerant to the condenser become unnecessary. As a result, the deterioration in efficiency of the refrigerator can be suppressed, and the entire refrigerator can be reduced in size by space saving.

In the present invention, the turbo refrigerator may include a driving machine configured to drive the compressor, wherein the evaporator may be provided around the driving machine. According to this configuration, one advantage is that the driving machine can be cooled down by the evaporator.

In the present invention, the evaporator may be provided at one side or the other side of the turbo compressor in the axial direction, and the driving machine configured to drive the turbo compressor may be provided at its opposite side. According to this configuration, it is possible to prevent an adverse effect in which the evaporator is heated by heat generated by the driving machine.

In the present invention, at least the evaporator, the turbo compressor, and the condenser may be housed in the housing. In the present invention, the condenser is provided at a position around and in the vicinity of the turbo compressor. Therefore, the connecting pipe through which the vapor refrigerant flowing out from the turbo compressor and collected by the scroll is introduced to the condenser becomes unnecessary, and the evaporator, the compressor, and the condenser can be housed in the housing. On this account, the turbo refrigerator obtains a compact structure.

In the configuration in which the evaporator, the turbo compressor, and the condenser are housed in the housing, a return passage through which the liquid-phase refrigerant returns from the condenser to the evaporator may be provided in the housing. The return passage through which the liquid-phase refrigerant having a low volume flow rate flows may have a small diameter. Therefore, by providing the return passage in the housing, the turbo refrigerator can obtain a further compact structure.

Advantageous Effects of Invention

According to the turbo refrigerator of the present invention, the condenser is provided outside the turbo compressor so as to overlap the turbo compressor when viewed from each of the axial direction and radial direction of the turbo compressor. Therefore, the vapor refrigerant radially flowing out from the impeller can be directly supplied to the condenser without flowing through the scroll and the connecting pipe. The scroll and connecting pipe between the turbo compressor and the condenser become unnecessary, so that the deterioration in efficiency of the refrigerator can be suppressed. Further, the condenser is provided by effectively utilizing the space around the turbo compressor, so that the entire refrigerator can be reduced in size by space saving.

DESCRIPTION OF EMBODIMENTS

Hereinafter, preferred embodiments of the present invention will be explained in detail in reference to the drawings.

Figure 1:
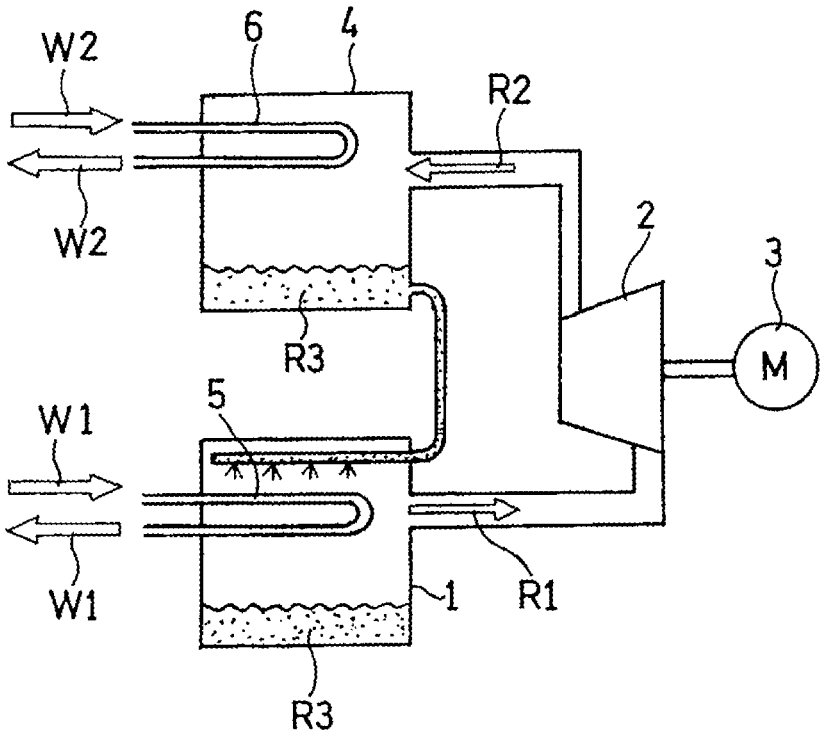
FIG. 1 is a schematic configuration diagram showing an operation principle of a turbo refrigerator according to Embodiment 1 of the present invention.

FIG. 1 is a schematic configuration diagram showing a turbo refrigerator according to Embodiment 1 of the present invention. In Embodiment 1, water is used as a refrigerant. In this turbo refrigerator, a liquid refrigerant (liquid-phase refrigerant) R3 is sprayed onto a heat exchanger tube 5 from above in an evaporator 1 to be evaporated, and by evaporation heat of the refrigerant, heat is extracted from a cooling target (cold water, for example) W1 flowing in the heat exchanger tube 5. Then, a low-pressure vapor refrigerant R1 (gas-phase refrigerant) is suctioned and compressed by a turbo compressor 2 driven rotationally by a driving machine 3, such as an electric motor. With this, a high-pressure vapor refrigerant R2 is obtained and supplied to a condenser 4. The vapor refrigerant R2 dissipates the heat with respect to a heat removing object (cooling water, for example) W2 flowing in a cooling tube 6 in the condenser 4. Thus, the vapor refrigerant R2 becomes the liquid refrigerant R3, and the liquid refrigerant R3 is supplied to the evaporator 1.

In the turbo refrigerator, water having a higher boiling point than, for example, chlorofluorocarbon that is a conventionally typical refrigerant is used as a refrigerant. Therefore, the compressor 2 operates under negative pressure, for example, 1/100 atmosphere at an inflow side thereof and 1/10 atmosphere at an outflow side thereof. Therefore, the refrigerant decreases in density and increases in volume flow rate, so that the turbo refrigerator increases in size as compared to a refrigerator using, for example, the chlorofluorocarbon as the refrigerant. The vapor refrigerant R2 is supplied from the compressor 2 to the condenser 4. The cold water W1 in the heat exchanger tube 5 is cooled down in the evaporator 1, for example, from 12° C. to 7° C. and then flows out to be used for, for example, indoor cooling of a building. The cooling water W2 in the cooling tube 6 removes the heat from the vapor refrigerant R2 in the condenser 4, increases in temperature, for example, from 32° C. to 37° C., and is then supplied to a cooling tower.

Figure 2:
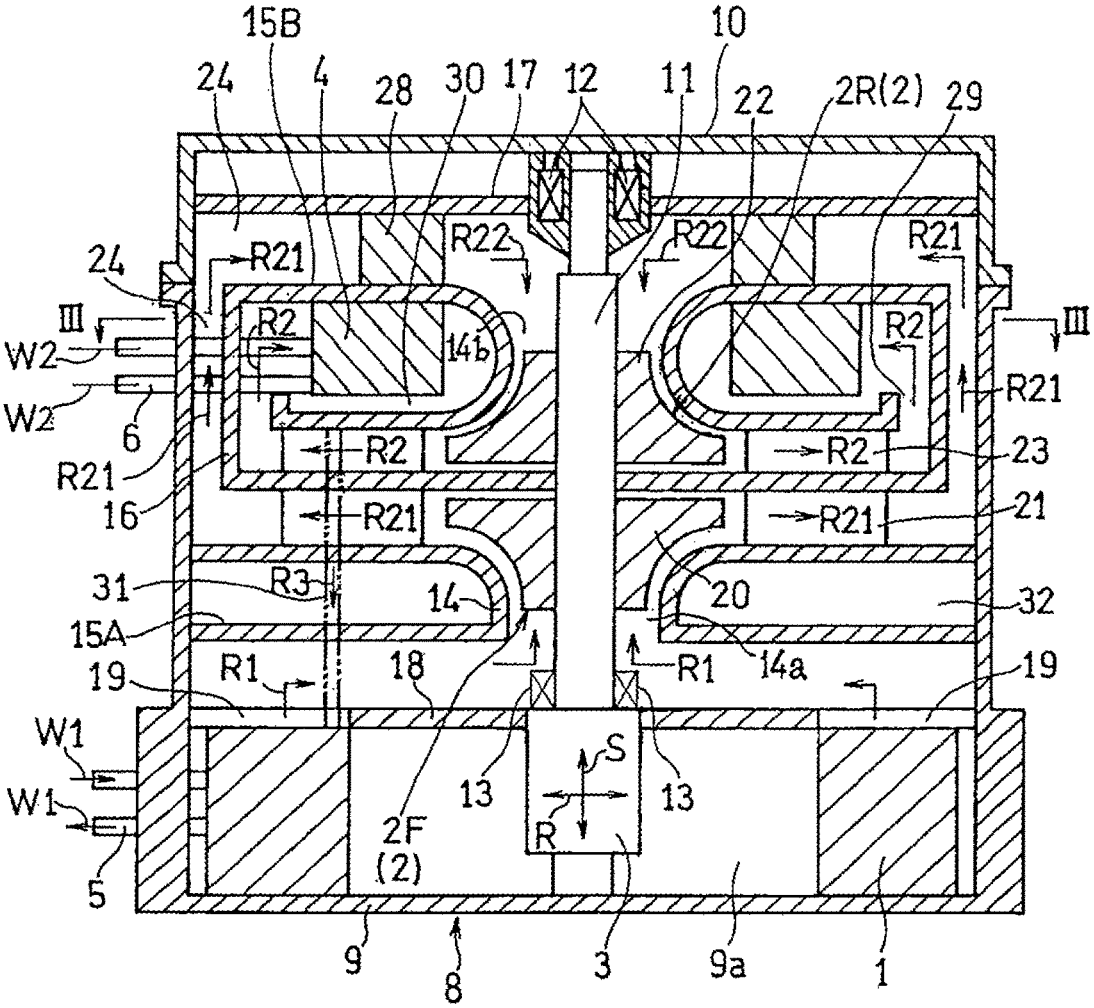
FIG. 2 is a vertical sectional view showing the above turbo refrigerator.

In FIG. 2 showing a vertical sectional view of the turbo refrigerator, a housing 8 that is an exterior body is configured such that an upper opening portion of a bottomed cylindrical housing main body 9 is sealed by a housing lid body 10. The housing 8 houses major components, such as the evaporator 1, the compressor 2, and the condenser 4, of the turbo refrigerator. The compressor 2 is arranged concentrically with the housing 8 such that a rotation axis of the compressor 2 substantially coincides with a center line of the housing 8 having a substantially cylindrical shape.

An electric motor 3 configured to drive the compressor 2 is provided at a bottom portion 9*a* of the housing main body 9 and is directly coupled to a rotating shaft 11 of the compressor 2. The rotating shaft 11 extends in an upper-lower direction. An upper end portion of the rotating shaft 11 is rotatably supported by an inner wall portion 17 of the housing lid body 10 via a bearing 12, and a lower portion thereof is rotatably supported by the housing main body 9 via a bearing 13 and the electric motor 3.

A ring-shaped attachment plate 18 is externally fitted to and fixed to a case of the electric motor 3 at the bottom portion 9*a* of the housing main body 9, and the attachment plate 18 is fixed to a peripheral wall of the bottom portion 9*a* of the housing main body 9 by a plurality of radial stays 19. To be specific, the electric motor 3 is supported by the housing main body 9 via the attachment plate 18 and the plurality of stays 19. The evaporator 1 having a circular shape is arranged under the plurality of radial stays 19 so as to surround the electric motor 3.

A front-stage defining wall 15A is provided above the attachment plate 18 and the plurality of stays 19 so as to be spaced apart from the attachment plate 18 and the plurality of stays 19. An opening at the center of the front-stage defining wall 15A communicates with a front-stage inlet portion 14*a* (suction port at one side in an axial direction of a compressor front stage) that opens at a lower portion of a casing 14 of the compressor 2. In other words, the front-stage defining wall 15A spreads from the front-stage inlet portion of the casing 14 of the compressor 2 toward an outer periphery, and an outer peripheral edge of the front-stage defining wall 15A is joined to an inner surface of a peripheral wall of the housing main body 9. The vapor refrigerant R1 from the evaporator 1 receives a suction force, generated by the compressor 2, to flow upward through spaces among the stays 19. Then, the vapor refrigerant R1 flows through a passage between the attachment plate 18 and the front-stage defining wall 15A to be suctioned by the compressor 2.

As with the front-stage defining wall 15A, a rear-stage defining wall 15B is provided between an outer periphery of a rear-stage inlet portion 14*b* (suction port at the other side in the axial direction of a compressor rear stage) that opens at an upper portion of the casing 14 of the compressor 2 and a peripheral wall of the housing main body 9 surrounding the outer periphery of the rear-stage inlet portion 14*b*. The rear-stage defining wall 15B is arranged under the inner wall portion 17 of the housing lid body 10 so as to be spaced apart from the inner wall portion 17. As described below, a portion between the rear-stage defining wall 15B and the inner wall portion 17 serves as a part of an intermediate passage 24 through which the refrigerant is introduced from a compressor front stage 2F to a compressor rear stage 2R.

The compressor 2 is a two-stage centrifugal type in which the compressor front stage 2F on a lower side and the compressor rear stage 2R on an upper side are arranged back-to-back. The compressor front stage 2F is constituted by a front-stage impeller 20 and a front-stage diffuser 21 located on an outer side of the front-stage impeller 20 in a radial direction. The compressor rear stage 2R is constituted by a rear-stage impeller 22 and a rear-stage diffuser 23 arranged concentrically with the rear-stage impeller 22 so as to be located on an outer side of the rear-stage impeller 22 in a radial direction R.

The front-stage impeller 20 suctions the vapor refrigerant R1 from the evaporator 1 through the inlet portion 14*a* upward along an axial direction S of the rotating shaft 11, causes the vapor refrigerant R1 to flow outward in the radial direction R, and causes the vapor refrigerant R1 to flow outward in the radial direction R through an outlet of an outer periphery of the front-stage impeller 20. A vapor refrigerant R21 having flowed out from the front-stage impeller 20 flows through the front-stage diffuser 21 to further flow outward in the radial direction R, that is, toward the peripheral wall of the housing main body 9.

The vapor refrigerant R21 discharged from the front-stage diffuser 21 as described above flows upward through a space between the peripheral wall of the housing main body 9 and a cylindrical passage inner wall 16 provided at an inner side of the peripheral wall of the housing main body 9 in the radial direction R so as to be spaced apart from the peripheral wall of the housing main body 9. Then, the vapor refrigerant R21 reaches a space above the rear-stage defining wall 15B and flows toward the inner side in the radial direction R through a space between the rear-stage defining wall 15B and the inner wall portion 17 located above the rear-stage defining wall 15B. Then, the vapor refrigerant R21 is suctioned through the rear-stage inlet portion 14*b* to the compressor rear stage 2R.

To be specific, the intermediate passage 24 is formed, which extends from the outer peripheral edge of the front-stage diffuser 21 through the space between the peripheral wall of the housing main body 9 and the passage inner wall 16 and the space between the rear-stage defining wall 15B and the inner wall portion 17 located above the rear-stage defining wall 15B to the rear-stage inlet portion 14*b* to introduce the refrigerant from the compressor front stage 2F to the compressor rear stage 2R. An intermediate cooler 28 constituted by a heat exchanger is disposed on the intermediate passage 24 so as to be located between the rear-stage defining wall 15B and the inner wall portion 17. The vapor refrigerant R21 is cooled down by the intermediate cooler 28 when flowing through the intermediate passage 24. For example, water is used as a coolant of the intermediate cooler 28.

The vapor refrigerant R22 having flowed out from the intermediate cooler 28 is suctioned through the rear-stage inlet portion 14*b* downward along the axial direction S of the rotating shaft 11 and flows outward in the radial direction R through an outlet of the outer periphery of the rear-stage impeller 22. The vapor refrigerant R2 having flowed out from the rear-stage impeller 22 as described above flows through the rear-stage diffuser 23 outward in the radial direction R, that is, toward the peripheral wall of the housing main body 9 to flow out from a circular outlet 29.

A circular space 30 whose outer side in the radial direction R is surrounded by the passage inner wall 16 is formed between the rear-stage diffuser 23 and the rear-stage defining wall 15B located above the rear-stage diffuser 23, and the circular outlet 29 opens to face the space 30. The condenser 4 is provided in the circular space 30, and the vapor refrigerant R2 having flowed out through the outlet 29 directly, smoothly flows into the condenser 4. The vapor refrigerant R2 is condensed in the condenser 4 to become the liquid refrigerant R3, and the refrigerant R3 flows through a return passage 31 to return to the evaporator 1, the return passage 31 being constituted by a pipe shown by a virtual line in FIG. 2 and having a small diameter. The return passage 31 is provided in the housing 8 and penetrates the front-stage diffuser 21 and the rear-stage diffuser 23 in the axial direction S. The return passage 31 may be provided so as to extend outside the housing 8.

As described above, in the turbo refrigerator according to the present embodiment, the condenser 4 is provided outside the compressor rear stage 2R so as to overlap the compressor rear stage 2R when viewed from each of the axial direction S and the radial direction R, that is, the condenser 4 is provided at a position in the vicinity of the rear-stage impeller 22 of the compressor rear stage 2R and at an outer side of the rear-stage impeller 22 in the radial direction R. Then, the vapor refrigerant R2 having flowed out from the rear-stage impeller 22 of the compressor 2 is directly, smoothly introduced through the rear-stage diffuser 23 to the condenser 4. Therefore, both a conventionally typical scroll in a centrifugal turbo compressor and a long connecting pipe through which a refrigerant collected by the scroll is introduced to a condenser are unnecessary. Since there is no pressure loss generated by the scroll and the connecting pipe, the deterioration in efficiency of the refrigerator can be suppressed.

The position in the vicinity of the rear-stage impeller 22 of the compressor rear stage 2R and at the outer side of the rear-stage impeller 22 in the radial direction R is a large dead space in the conventional turbo refrigerator. Therefore, by utilizing this place as an installation location of the condenser 4, the entire refrigerator can be reduced in size by space saving. Especially in the present embodiment, water which has a high boiling point is used as the refrigerant. Therefore, the operation pressure is low, and the refrigerant decreases in density. On this account, it is necessary to use the compressor 2 including the impellers 20 and 22 each having a comparatively large diameter. Thus, the large circular space 30 exists at an outer side of and in the vicinity of the compressor rear stage 2R, constituted by the rear-stage impeller 22 and the rear-stage diffuser 23, so as to overlap the compressor rear stage 2R when viewed from each of the axial direction S and the radial direction R, and the condenser 4 can be easily provided at this space 30.

As clearly shown in FIG. 2, in the present embodiment, the condenser 4 is provided so as to entirely overlap the compressor rear stage 2R constituted by the rear-stage impeller 22 and the rear-stage diffuser 23. However, the condenser 4 may be provided such that a part thereof overlaps the compressor rear stage 2R. For example, the condenser 4 may be provided such that a portion thereof except for a portion (upper portion in FIG. 2) located at one side in the axial direction overlaps the compressor rear stage 2R. In addition, a circular space 32 exists so as to overlap the compressor front stage 2F, constituted by the front-stage impeller 20 and front-stage diffuser 21, when viewed from each of the axial direction S and the radial direction R. Therefore, for example, by providing a part of the evaporator 1 or the entire evaporator 1 at the space 32, the space can be effectively utilized.

Further, in the present embodiment, the circular space 30 in which the condenser 4 is provided as described above is formed between the rear-stage diffuser 23 and the rear-stage defining wall 15B, located above the rear-stage diffuser 23, so as to be surrounded by the passage inner wall 16 from the outer side in the radial direction R. Therefore, the vapor refrigerant R2 from the compressor rear stage 2R can be supplied to the condenser 4 in the space 30 without flowing across the intermediate passage 24 extending from the outside of the passage inner wall 16 to the space above the rear-stage defining wall 15B. On this account, the refrigerant passage between the compressor rear stage 2R and the condenser 4 becomes short and simple in shape.

The vapor refrigerant R21 that has been compressed by the compressor front stage 2F and increased in temperature is cooled down by the intermediate cooler 28 and then supplied to the compressor rear stage 2R. Therefore, the compression efficiency of the compressor 2 improves. In addition, since the scroll and connecting pipe located downstream of the compressor rear stage 2R are unnecessary as described above, the major components, such as the evaporator 1, the compressor 2, and the condenser 4, can be housed in the housing 8, so that a compact structure is realized. Further, as the return passage 31 through which the liquid refrigerant R3 having a low volume flow rate returns to the evaporator 1 from the condenser 4, the pipe having the small diameter can be provided in the housing 8, so that the further compact structure is realized.

Furthermore, since the evaporator 1 is provided so as to surround the driving machine 3, configured to drive the compressor 2, from the outer side in the radial direction R, radiant heat from the driving machine 3 can be absorbed by the evaporator 1 that is comparatively low in temperature, so that the driving machine 3 can be cooled down.

Figure 3:
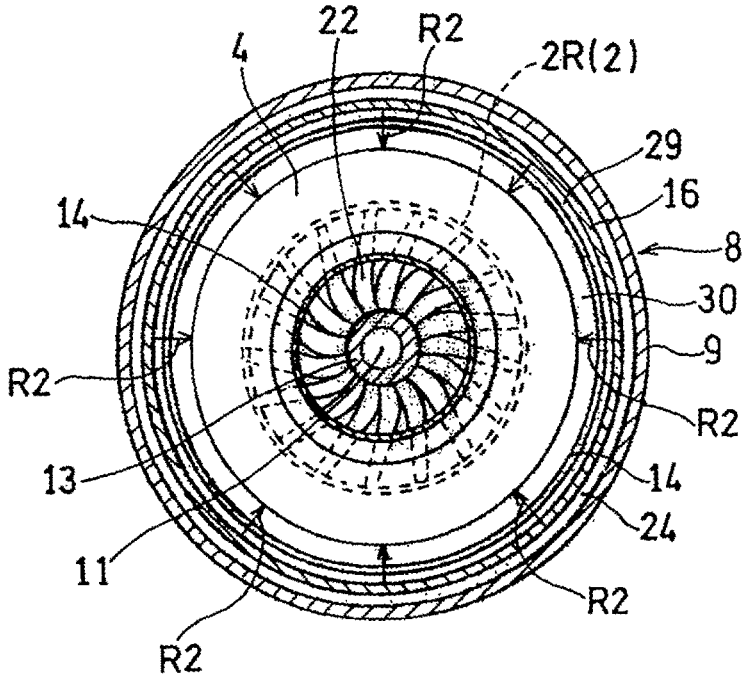
FIG. 3 is a cross-sectional view taken along line III-III of FIG. 2.
Figure 4:
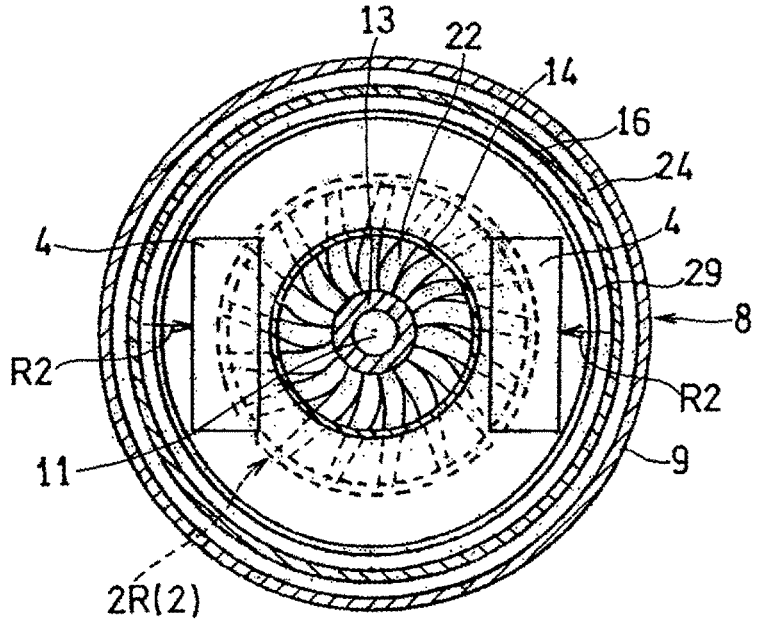
FIG. 4 is a cross-sectional view showing a modification example of the turbo refrigerator of FIG. 3.
Figure 5:
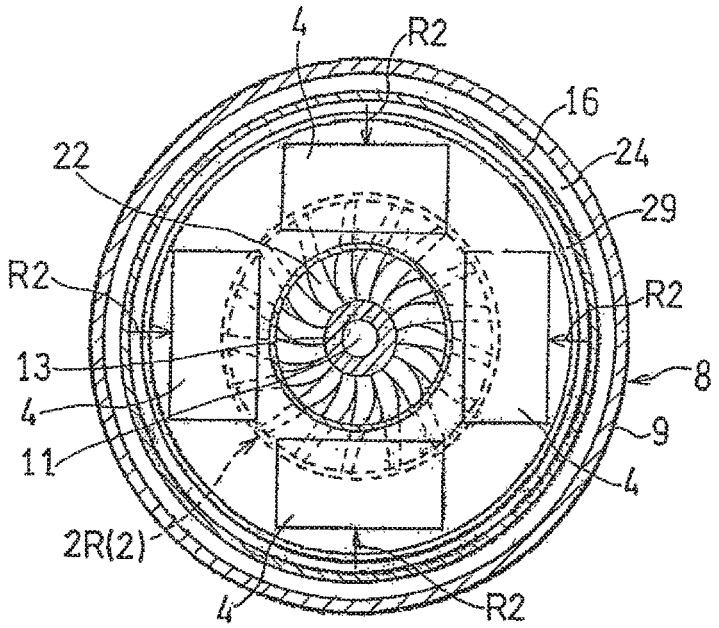
FIG. 5 is a cross-sectional view showing another modification example of the turbo refrigerator of FIG. 3.

The condenser 4 is not limited to the circular condenser shown in FIG. 3. As shown in FIG. 4, two rectangular-solid or circular-arc condensers 4 may be provided so as to be opposed to each other in the radial direction R of the rear-stage impeller 22. In addition, as shown in FIG. 5, four cubic condensers 4 may be provided outside the rear-stage impeller 22 so as to be located concentrically with the rear-stage impeller 22 at angular intervals of 90°.

Figure 6:
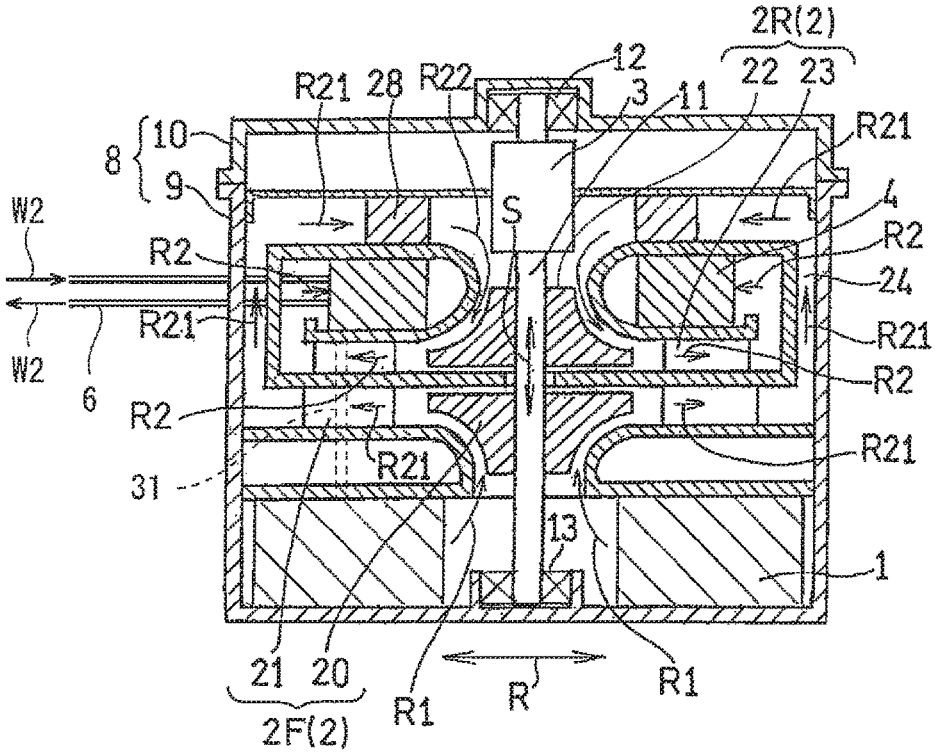
FIG. 6 is a vertical sectional view showing the turbo refrigerator according to Embodiment 2 of the present invention.

FIG. 6 shows the turbo refrigerator according to Embodiment 2 of the present invention. The turbo refrigerator of Embodiment 2 is different from the turbo refrigerator of Embodiment 1 in that the electric motor 3 configured to drive the compressor 2 is provided above the compressor 2 (at one side or the other side in the axial direction of the compressor 2) and spaced apart from the evaporator 1 provided on its opposite side. The present embodiment has an advantage in which it is possible to prevent an adverse effect in which the evaporator 1 is heated by the heat generated by the electric motor 3.

Figure 7:
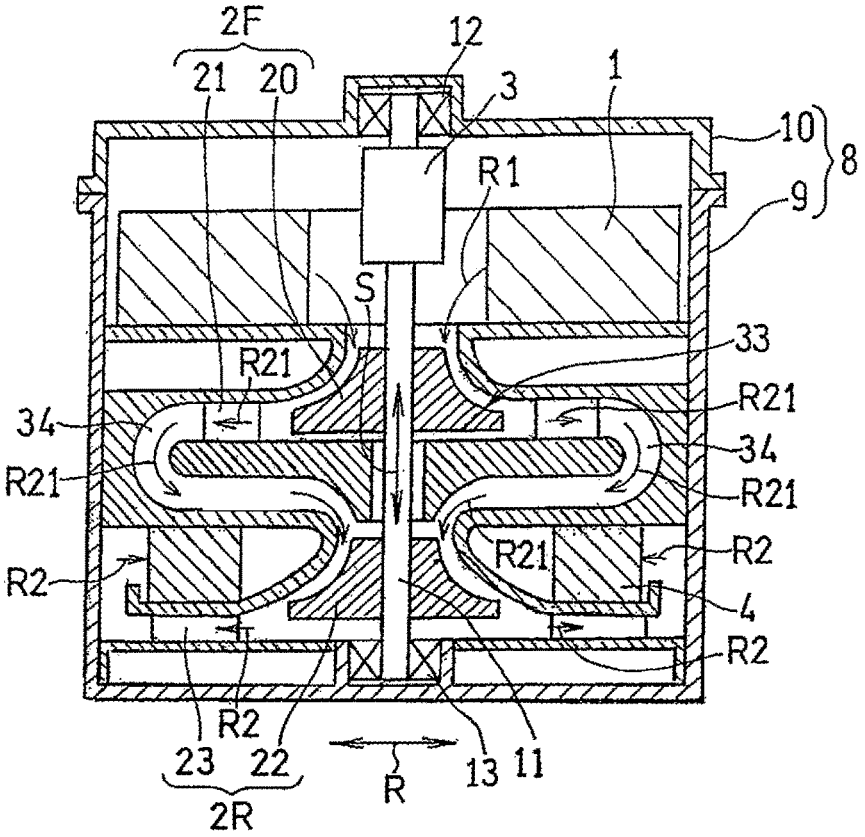
FIG. 7 is a vertical sectional view showing the turbo refrigerator according to Embodiment 3 of the present invention.

FIG. 7 shows the turbo refrigerator according to Embodiment 3 of the present invention. This turbo refrigerator includes a two-stage centrifugal compressor 33 in which the impeller 20 of the compressor front stage 2F and the impeller 22 of the compressor rear stage 2R are arranged in series and have the same orientation. The circular evaporator 1 is provided above the compressor 33, and the electric motor 3 is provided at an inner side of the evaporator 1 in the radial direction R. The vapor refrigerant R21 having flowed from the front-stage impeller 20 through the front-stage diffuser 21 is introduced to an inlet of the rear-stage impeller 22 through a crossover-shaped intermediate passage 34 (return channel) that turns down at an angle of 180°. The condenser 4 is provided at a position in the vicinity of the rear-stage impeller 22 of the compressor rear stage 2R and at the outer side of the rear-stage impeller 22 in the radial direction R so as to overlap the compressor rear stage 2R when viewed from each of the axial direction S and the radial direction R.

With this, unlike this type of conventional turbo refrigerator, the vapor refrigerant R2 having flowed out from the rear-stage impeller 22 can be directly, smoothly supplied to the condenser 4 without flowing through the scroll and the long connecting pipe. Therefore, there is no pressure loss generated by the scroll and the connecting pipe, so that the deterioration in efficiency of the refrigerator can be suppressed. In addition, the condenser 4 is provided by effectively utilizing the space around the rear-stage impeller 22, so that the dead space can be reduced, and the space can be saved. Thus, the entire refrigerator can be reduced in size.

In the compressor 33 of the serial arrangement, both the compressor front stage 2F and the compressor rear stage 2R face upward in FIG. 7. Therefore, the compressor 33 does not basically have a possible problem of the back-to-back type two-stage centrifugal compressor, that is, a problem that the intermediate passage 34 connecting the compressor front stage 2F and the compressor rear stage 2R intersects with the passage connecting the compressor rear stage 2R and the condenser 4.

Figure 8:
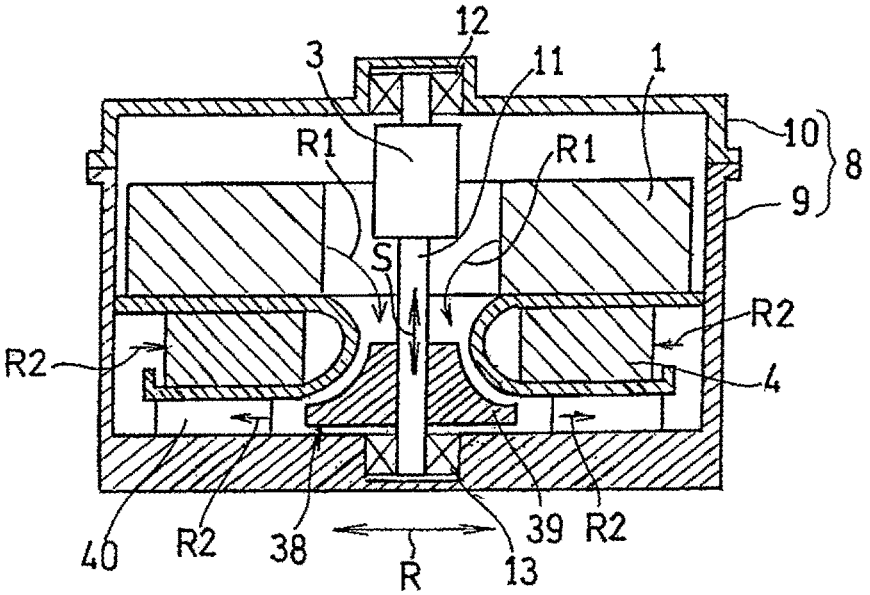
FIG. 8 is a vertical sectional view showing the turbo refrigerator according to Embodiment 4 of the present invention.

FIG. 8 shows the turbo refrigerator according to Embodiment 4 of the present invention. This turbo refrigerator includes a single-stage centrifugal compressor 38 including a single impeller 39 and a single diffuser 40. The condenser 4 is provided at an outer side of the impeller 39 of the compressor 38 in the radial direction R so as to overlap the compressor 38 when viewed from each of the axial direction S and the radial direction R. Therefore, in the turbo refrigerator, the vapor refrigerant R2 can be directly, smoothly supplied to the condenser 4 without flowing through the scroll and the connecting pipe. On this account, there is no pressure loss generated by the scroll and the connecting pipe, so that the deterioration in efficiency of the refrigerator can be suppressed. In addition, since the condenser 4 is provided by utilizing the space around the impeller 39, the dead space can be eliminated, and the space can be saved. Thus, the entire refrigerator can be reduced in size.

Each of the above-described embodiments has explained a vertical type in which the rotating shaft 11 of the compressor 2, 33, or 38 extends in the upper-lower direction. However, the present invention is also applicable to a horizontal type in which the rotating shaft 11 of the compressor 2, 33, or 38 extends in a horizontal direction. The structure shown in FIG. 6 in which the evaporator 1 and the electric motor 3 are respectively arranged at opposite sides so as to sandwich the compressor 2 is also applicable to Embodiment 3 shown in FIG. 7 and Embodiment 4 shown in FIG. 8. Further, the electric motor 3 configured to drive the compressor 2, 33, or 38 may be provided outside the housing 8. A speed-increasing gear may be provided between the electric motor 3 and the compressor 2, 33, or 38.

The present invention is not limited to the contents described in the above embodiments. Various additions, modifications, and deletions may be made within the spirit of the present invention, and such modifications and the like are also included in the scope of the present invention.

The invention claimed is:

1. A turbo refrigerator comprising:

a turbo compressor configured to compress a gas-phase refrigerant;

a condenser configured to condense the gas-phase refrigerant compressed by the turbo compressor and perform heat exchange between a heat removing object flowing in a cooling tube penetrating the condenser and the gas-phase refrigerant; and an evaporator configured to evaporate a liquid-phase refrigerant obtained by the condenser to cool down a cooling target by evaporation heat of the liquid-phase refrigerant, wherein:

the turbo compressor is a centrifugal type including one or a plurality of impellers and one or a plurality of diffusers and configured to cause the gas-phase refrigerant to flow in a radially outward direction, the one or a plurality of diffusers being located on a radially outer side of the one or a plurality of impellers;

the condenser is entirely arranged in a space around the one impeller or one of the plurality of impellers, the space being located on one axial side of the one diffuser corresponding to the one impeller or one of the plurality of diffusers corresponding to the one of the plurality of impellers; and the condenser is provided outside the turbo compressor so as to overlap the turbo compressor when viewed from each of an axial direction and radial direction of the turbo compressor.

2. The turbo refrigerator according to claim 1, wherein:

the turbo compressor is a two-stage centrifugal type in which a compressor front stage and a compressor rear stage include the respective impellers and the respective diffusers and are arranged back-to-back so as to be lined up in the axial direction of the turbo compressor;

the condenser is entirely arranged in a space around the impeller of the compressor rear stage, the space being located on one axial side of the diffuser of the compressor rear stage; and the condenser is provided so as to overlap the compressor rear stage when viewed from each of the axial direction and radial direction of the turbo compressor.

3. The turbo refrigerator according to claim 2, wherein:

the compressor front stage and the compressor rear stage are lined up in this order from a first side in the axial direction toward a second side in the axial direction, the turbo refrigerator further comprising an intermediate passage through which the refrigerant discharged from a radially outer side of the compressor front stage is introduced to a suction port of the compressor rear stage, the suction port being located at the second side in the axial direction, wherein the condenser is provided at a space between the intermediate passage and the compressor rear stage.

4. The turbo refrigerator according to claim 3, wherein an intermediate cooler configured to cool down the refrigerant introduced from the compressor front stage to the compressor rear stage is provided at the second side in the axial direction of the turbo compressor when viewed from the condenser.

5. The turbo refrigerator according to claim 1, wherein:

the turbo compressor is a multiple-stage centrifugal type including two or more compressor stages including the respective impellers and the respective diffusers and lined up in the axial direction;

the condenser is entirely arranged in a space around the impeller of a rearmost one of the compressor stages, the space being located on one axial side of the diffuser of the rearmost compressor stage; and the condenser is provided so as to overlap the rearmost compressor stage when viewed from each of the axial direction and radial direction of the turbo compressor.

6. The turbo refrigerator according to claim 1, wherein the turbo compressor is a single-stage centrifugal type.

7. The turbo refrigerator according to claim 1, further comprising a driving machine configured to drive the turbo compressor, wherein the evaporator is provided around the driving machine.

8. The turbo refrigerator according to claim 1, wherein the evaporator is provided at one of a first side and a second side in the axial direction of the turbo compressor, and a driving machine configured to drive the turbo compressor is provided at the other side of the first side and the second side in the axial direction of the turbo compressor.

9. The turbo refrigerator according to claim 1, wherein at least the evaporator, the turbo compressor, and the condenser are housed in a housing.

10. The turbo refrigerator according to claim 9, wherein a return passage through which the liquid-phase refrigerant returns from the condenser to the evaporator is provided in the housing.

* * * * *